United States Patent [19]

Bud et al.

[11] 4,315,144

[45] Feb. 9, 1982

[54] ELECTRICAL IMPULSE OPERATED NUMBER WHEEL COUNTERS

[75] Inventors: Hans Bud, London; Peter Alway, Bushey, both of England

[73] Assignee: Mecom Standard Limited, London, England

[21] Appl. No.: 102,330

[22] Filed: Dec. 11, 1979

[30] Foreign Application Priority Data

Dec. 14, 1978 [GB] United Kingdom ..... 48535/78

[51] Int. Cl.[3] ..... G06M 1/02

[52] U.S. Cl. ..... 235/92 C

[58] Field of Search ..... 235/92 C, 92 R, 92 FP

[56] References Cited

U.S. PATENT DOCUMENTS 3,916,164 10/1975 Kundisch et al. ..... 235/92 C
3,935,433 1/1976 Cielaszyk et al. ..... 235/92 C
3,962,566 6/1976 Gebelein et al. ..... 235/92 C
4,012,624 3/1977 Haller et al. ..... 235/92 C
4,031,361 6/1977 Moll et al. ..... 235/92 C

*Primary Examiner*—Joseph M. Thesz
*Attorney, Agent, or Firm*—Curtis, Morris & Safford

[57] ABSTRACT

A counter comprises two housing parts which are a push fit together; two shafts located at their ends within recesses of one housing part and carrying, respectively, conventional number wheels and transfer pinions; a pawl rotatable about the transfer pinion shaft and engaging ratchet teeth on the first number wheel and a solenoid sub-assembly having an armature pivoting about an axis parallel with the transfer pinion axis for reciprocating the pawl. The solenoid sub-assembly is located by grooves and other elements formed inwardly of the housing and does not need to be riveted, screwed or otherwise rigidly secured.

9 Claims, 6 Drawing Figures

ELECTRICAL IMPULSE OPERATED NUMBER WHEEL COUNTERS

This invention relates to electrical impulse operated number wheel counters, and more particularly to such counters comprising a housing, a first shaft inside the housing, a series of coaxial freely rotatable number wheels mounted on the first shaft, a second shaft inside the housing disposed parallel with the first shaft, transfer pinions freely rotatably mounted on the second shaft and respectively disposed intermediate successive number wheels, each pinion meshing with gear teeth on one of the number wheels adjacent thereto and adapted to engage drive means on the other number wheel during rotation of said other number wheel, thereby partially to rotate said one of the number wheels, reciprocably movable pawl means adapted to engage teeth on a number wheel at an end of the series of number wheels, thereby to rotate said number wheel to effect counting of the counter, and electrical impulse actuated means having a frame, a solenoid mounted on the frame, an armature supported for reciprocal movement on the frame and biassing means serving, when the solenoid is de-energised, to keep the armature out of engagement with the solenoid, the armature serving to effect reciprocal movement of the pawl means when an electrical impulse energises the solenoid. Electrical impulse operated number wheel counters as just defined are hereinafter referred to as such counters "of the kind set forth".

With counters of the kind set forth, the normal practice is to provide a main frame within the housing of the counter on which all the components of the counter are supported. The use of a main frame may detract from the efficacy of the magnetic circuit of the solenoid, whilst the fitting of a separate main frame entails additional assembly costs. It is known to provide a separate frame for the solenoid on which the armature is carried and which together with the armature and solenoid core forms the magnetic circuit of the solenoid. Such a frame is secured within the housing by welds, rivets or screws and its accurate location, assembly and support within the housing is accordingly expensive to achieve.

The present invention consists in an electrical impulse operated number wheel counter of the kind set forth which is characterised in that the housing is formed in two parts of non-magnetic material which together provide a cavity for the electrical impulse actuated means, the housing having elements formed integrally therewith inwardly of the cavity which engage said frame and form the sole means for locating and retaining said electrical impulse actuated means within the housing; in that the armature is supported on the frame for generally pivotal movement relative thereto about an axis parallel to said first and second shafts and in that the armature directly engages the pawl means in a manner permitting relative movement therebetween radially of said axis.

With the construction according to the invention, the solenoid, the frame on which it is mounted, the armature and biassing means together form a sub-assembly which is lowered into one part of the housing so that elements formed integrally with the housing engage the frame thereby locating the sub-assembly relative to that part of the housing. The form of engagement between the armature and the pawl means enables these to be mutually engaged simultaneously with the lowering of the sub-assembly into the housing part. The other part of the housing can then be fitted to close the housing, in the course of which further elements formed in said other part of the housing preferably engage the frame further stabilising the mounting of the frame in the housing. This manner of assembly greatly reduces assembly costs and permits the use of a magnetic circuit of optimum form with the result that operation of the device results in reduced power consumption. Furthermore, the solenoid sub-assembly can be tested separately before the counter is assembled.

Preferably, the elements formed integrally with the housing comprise opposed grooves in one housing part cooperating respectively with opposed edges of the frame.

Advantageously, the parts of the housing are each formed with channels adapted to engage and retain edges of a base or mounting plate of the counter so that the base or mounting plate can be trapped between the housing parts as these are brought together on assembly of the counter.

The invention will now be described, by way of example, with reference to the accompanying, somewhat diagrammatic, drawings in which.

Figure 1:
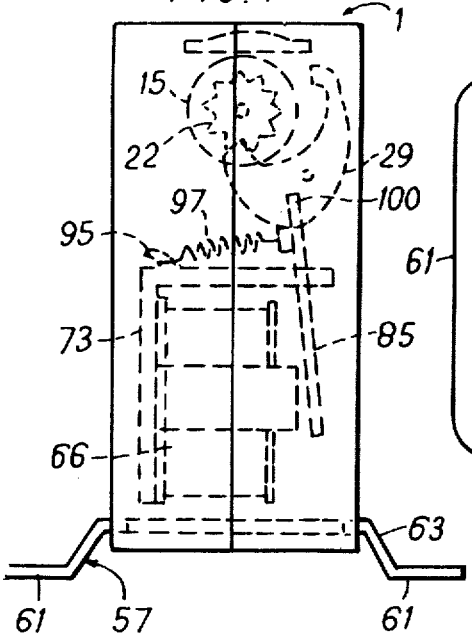
FIG. 1 is a side elevation of an electrical impulse operated number wheel counter according to the invention and illustrating in broken lines certain components within the counter.
Figure 3:
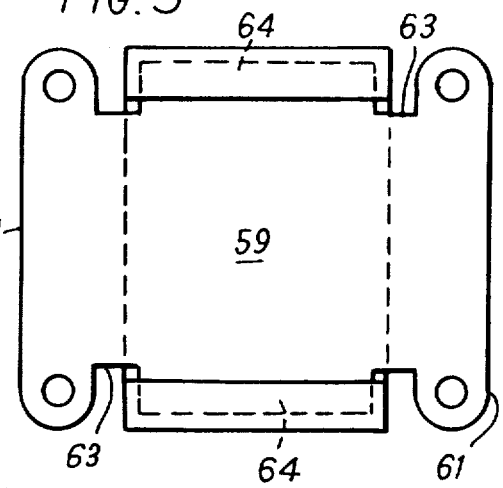
FIG. 3 is an under-plan of the counter of FIG. 1.

Referring to the drawings, an electrical impulse operated number wheel counter comprises a housing 1 formed by two generally similar parts 3 and 5. The part 3 is formed along upright sides thereof with respective male elements 7 and female elements 9, 10 and 12, whilst the part 5 is similarly formed at opposite sides thereof with female elements 11 which correspond with male elements 7 of the part 3 and with male elements 13, 14 and 16 which correspond with female elements 9, 10 and 12. On bringing together of the housing parts, the male elements 7 co-operate with the female elements 11 and the male elements 13, 14 and 16 co-operate with the female elements 9, 10 and 12 to provide a secure friction fit.

A series of coaxial number wheels 15 are freely rotatably mounted on a first shaft 17, ends of which engage in respective coaxial recesses 19 disposed in respective sides of the housing part 3. When the housing part 5 is fitted to the housing part 3, elements 20 at opposite sides of the housing part 4 co-operate with the recesses 19 to form blind apertures in which respective ends of the first shaft 17 are located. The number wheels 15 are of known form, having an opposite sides thereof gear teeth 21 and a drive element 24.

Extending parallel with the first shaft 17 is a second shaft 23 on which are freely rotatably mounted the transfer pinions 25, the teeth of each pinion 25 meshing with the gear teeth 21 of one of the adjacent number wheels whilst the drive element 24 on the other of the adjacent number wheels engages the pinion once per revolution of that number wheel to drive that pinion through an angle sufficient to drive the teeth 21 of the number wheel with which that pinion is engaged sufficiently to effect a count of that number wheel. At an end of the second shaft 23 there is freely rotatably mounted thereon a pawl 29 having drive elements 31 and 33. As hereinafter referred to, the pawl 29 is reciprocably rotated to effect a count. On reciprocation of the pawl 29, movement in one sense of the pawl effects engagement between the drive element 31 and the teeth 22 of a wheel at one end of the series of number wheels 15 to rotate that wheel through a first part of the angle required to effect a count, whilst the reverse rotation of the pawl 29 causes the drive element 33 to engage the teeth 22 and rotate the said number wheel through the remainder of the angle required to effect the count. The teeth 22 on the wheel at one end of the series of wheels 15 are, it will be appreciated, ratchet teeth which are engaged by the pawl 29 whereas the teeth 21 on the remaining wheels 15 are gear teeth which mesh with the pinions 25.

The ends of the second shaft 23 engage in slots 35 formed in respective projections which extend at opposite sides of the part 3 of the housing. When the parts 3 and 5 of the housing are fitted together the slots 35 are closed to form blind apertures in which the ends of the second shaft 23 are trapped by elements 37 in part 5 of the housing.

The parts 3 and 5 of the housing are further formed with respective grooves 39 and 41 which, when the housing is assembled, are disposed in opposed relationship and engage side flanges 43 and 45 of a lens 47 through which the numbers on the number wheels are read.

At the end of the housing remote from the lens 47, the part 3 of the housing is formed at opposite sides thereof with grooves 49 and 51 which extend normal to the groove 39. Similarly, in the housing part 5, there are provided at opposite sides thereof grooves 53 and 55 which extend normal to the groove 41. When the housing parts 3 and 5 are fitted together, the groove 49 extends collinearly with the groove 53 and the groove 51 extends collinearly with the groove 55. The combined groove formed by grooves 49 and 53 in the assembled housing straddles the parts 3 and 5 of the housing and is located in facing relationship with the combined groove formed by grooves 51 and 55, which also straddles the housing parts 3 and 5. The ends of each combined groove remote from the interface between housing parts 3 and 5 are closed.

A mounting plate 57, having a central rectangular portion 59 and side flanges 61 connected to the portion 59 by stepped elements 63, is fitted to the housing. To this end, the central portion 59 includes opposite edge parts 65 which are parallel and which respectively engage and are secured within the combined grooves formed by grooves 49 and 53 and by grooves 51 and 55.

Figure 2:
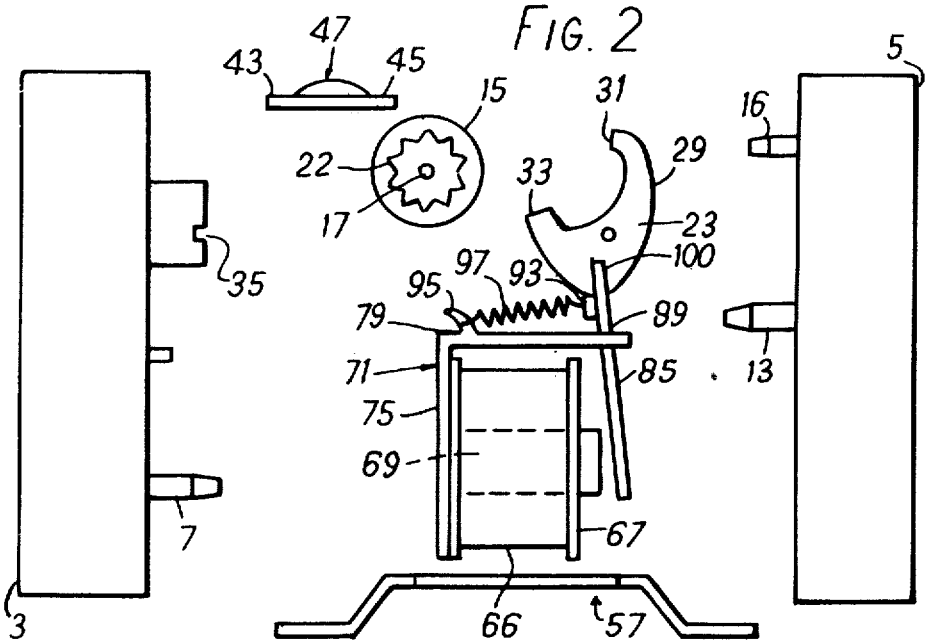
FIG. 2 is a side elevation of the counter of FIG. 1 illustrating in exploded form certain components of the counter.
Figure 4:
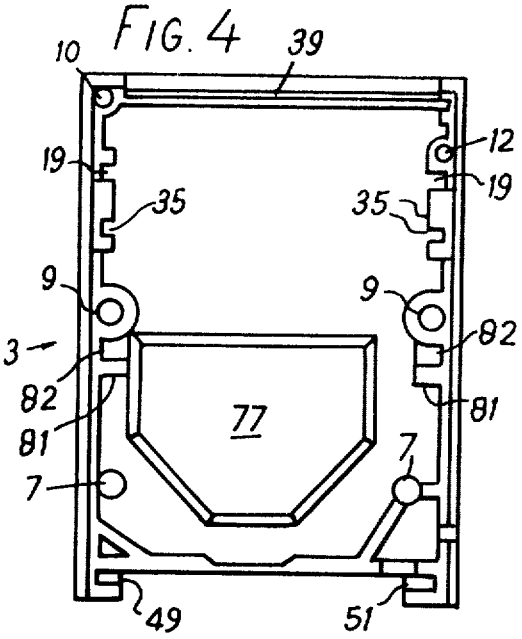
FIGS. 4 and 5 are elevational views showing the interior form of parts of the housing of the counter of the earlier figures.
Figure 5:
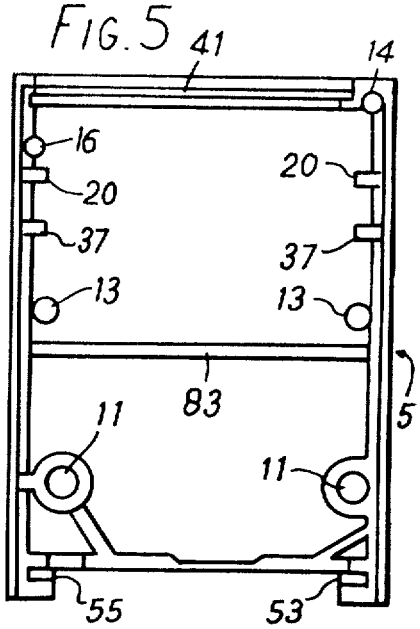
Figure 6:
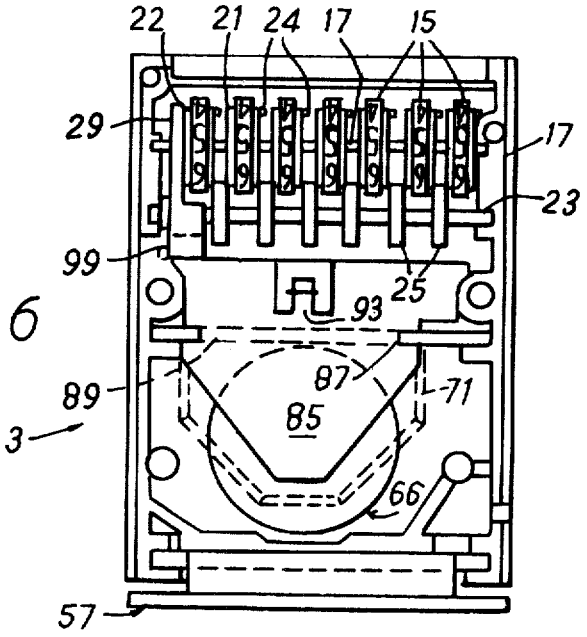
FIG. 6 is a view similar to FIG. 4 but showing interior parts located within the housing.

Electrical impulse actuated means of the counter comprises a solenoid 66 provided on a bobbin 67. The bobbin 67 threads over a solenoid core 69 which projects from a frame 71. The frame 71 is formed by an L-shaped plate 73 having a part 75 at right angles to which the core 69 extends, disposed within a complementary recess 77 in the housing part 3 and a part 79 which extends at right angles to the part 75 and towards the part 5 of the housing. The housing part 3 is formed at opposite sides thereof with ledges 81 between which and the female elements 9 are defined opposed slots 82 in which are engaged respective side edges of the part 79 of the frame 71. In the housing part 5 adjacent the male elements 13 is a ridge 83 which engages the edge of the part 79 of the frame 71 when the parts 3 and 5 of the housing are brought together. The magnetic circuit of the solenoid 66 is formed by the core 69 and the frame 71 and is completed by an armature 85 pivotally mounted on the edge of the part 79 of the frame 71 remote from the part 75 of the frame, the pivotal axis being parallel with shafts 17 and 23. The pivotal mounting of the armature 85 is effected by means of notches 87 which engage respective opposite ends of a rectangular recess 89 formed in the frame part 79. Armature 85 is formed with a spring anchor 93 between which and a similar anchor 95 provided on the frame part 79 is connected a helical biassing spring 97 which, when the solenoid 66 is de-energised, holds the armature 85 out of engagement with the core 69 of the solenoid. Whenever the solenoid is energised by a current pulse, the armature is attracted to the solenoid core, so stressing the spring 97. When the solenoid is de-energised, the spring 97 returns the armature to the position (shown in FIG. 2) where it is out of engagement with the core 69.

At the side adjacent the pawl 29, the armature 85 is formed with a tongue or lug 99 which projects into a slot 100 in the pawl extending radially of the shaft 23, so that whenever the armature is reciprocated as a result of a current pulse passing through the solenoid coil, reciprocation of the pawl 29 takes place to register a count on the number wheel 15 at the end of the series of number wheels with the teeth 22 of which the pawl 29 engages as hereinbefore described. It will be seen that the reciprocation of the armature 85 effects reciprocal movement in an opposite sense of the pawl 29.

In order to assemble the counter, the number wheels 15 are assembled on the first shaft 17 and the ends of the shaft 17 are engaged in the recesses 19. A special tool fits between the number wheels 15 to hold the number wheels so that they register a desired count. The second shaft 23, with the pinions 25 and drive pawl 29 assembled thereon, is then located so that the ends of the shaft 23 are engaged in the slots 35. At the same time, the solenoid 66 and frame 71, with the armature 85 and biassing spring 97 mounted on the frame, is lowered as a sub-assembly into the housing part 3 so that the side edges of the frame part 79 engage in the slots 82. In the course of this movement the lug 99 is caused to engage in the slot 100 of the drive pawl 29. The special tool holding the number wheels 15 at their predetermined count is then removed and the lens 47 has its flange 43 engaged with the groove 39, whilst the edges 65 of the base plate 57 are engaged in the grooves 49 and 51. The housing part 5 is then fitted to the housing part 3 to effect closure of the housing, as a result of which the ends of the shafts 17 and 23 are trapped between the parts of the housing and the solenoid and armature sub-assembly is located by elements 77, 82 and 83.

The manner of mounting the sub-assembly of the solenoid 66, frame 71 and armature 85 avoids the use of welds or rivets to retain the sub-assembly relatively to the parts of the housing, and this makes for considerably simplification in assembly of counter. By utilising a separate sub-assembly of the solenoid and magnetic circuit, there is enabled simplification of the mounting of the number wheels 15 and transfer pinions 25 in the housing. Where counters employ a main frame within a housing, which main frame is used to support the number wheels and transfer pinions and to provide part of the magnetic circuit, the fitting of the number wheels and transfer pinions is a laborious task involving threading the number wheel shaft and transfer pinion shaft through a side of the main frame, passing as the case may be the number wheels and pinions over their corresponding shafts and finally securing the ends of the shafts to opposite sides of the main frame by peening over the shaft ends. In contrast to this, the number wheels and pinions are completely assembled on their shafts 17 and 23 and simply lowered on to the housing part 3 so that the shaft ends engage the recesses provided for them.

Because the magnetic circuit and the solenoid are provided as a separate sub-assembly, there is enabled the mounting of the base plate to the housing by engagement of the base plate edges 65 in the grooves provided for them in the housing.

The construction according to the invention is further designed to minimise the power required to operate the counter. To this end, the mass of the armature 85 and the mass of the pawl 29 lying between the shaft 23 and the pivotal axis of the armature 85 is made substantially equal to the combined mass of the pawl 29 and the armature 85 lying outside the space between the shaft 23 and the pivotal axis of the armature 85 on the frame part 79. The parts which require to be reciprocated are thus essentially balanced. A further feature of the mechanism described is that the number wheels 15 employed are of somewhat smaller diameter than is typical for electrical impulse counters. With reduced size number wheels the inertia of the mechanism is reduced, and this - with the balanced arrangement of the pawl and armature - enables the device to operate with a minimum gap between the armature and solenoid core and thus with minimum flux leakage.

This invention has been described by way of example only and numerous modifications to the described embodiment are possible without departing from the scope of the invention. Thus the solenoid sub-assembly could be retained within the housing by a variety of elements formed integrally with the housing and not necessarily by engagement with a pair of opposed grooves as described. Indeed, the sub-assembly need not be immovably secured within the housing provided that the engagement with the locating elements of the housing sufficiently restrains movement of the sub-assembly to ensure correct functioning of the counter. The described tongue and slot connection between the pawl and the armature of the solenoid sub-assembly could be replaced by a coupling in which the positions of the tongue and slot are reversed or by any other form of direct engagement which permits relative movement between the pawl and the armature in a direction radially of the axis about which the armature pivots. This freedom of movement is necessary first, to enable the solenoid sub-assembly to be pushed into the housing part and simultaneously engaged with the pawl and, second, to accommodate sliding movement between the pawl and the armature as these reciprocate in use about their respective axes.

What is claimed is:

1. An electrical impulse operated number wheel counter, comprising a housing, a first shaft inside the housing, a series of coaxial freely rotatable number wheels mounted on the first shaft, a second shaft inside the housing disposed parallel with the first shaft, transfer pinions freely rotatably mounted on the second shaft respectively disposed intermediate successive number wheels, each pinion meshing with gear teeth on one of the number wheels adjacent thereto and adapted to engage drive means on the other number wheel during rotation of said other number wheel, thereby partially to rotate said one of the number wheels, reciprocably movable pawl means adapted to engage teeth on a number wheel at an end of the series of number wheels, thereby to rotate said number wheel to effect counting of the counter, and electrical impulse actuated means having a frame, a solenoid mounted on the frame, an armature supported for reciprocal movement on the frame and biassing means serving, when the solenoid is de-energised, to keep the armature out of engagement with the solenoid, the armature serving to effect reciprocal movement of the pawl means when an electrical impulse energises the solenoid; wherein the housing is formed of two parts of non-magnetic material which together provide a cavity for the electrical impulse actuated means, the housing having elements formed integrally therewith inwardly of the cavity which engage said frame and form the sole means of locating and retaining said electrical impulse actuated means within the housing, wherein the armature is supported on the frame for generally pivotal movement relative thereto about an axis parallel to said first and second shafts and wherein the armature directly engages the pawl means in a manner permitting relative movement therebetween radially of said axis.

2. A counter according to claim 1, wherein said elements formed integrally with the housing comprise opposed grooves in one housing part cooperating respectively with opposed edges of the frame.

3. A counter according to claim 2, wherein said elements further comprise a ridge formed in said other housing part and cooperable with the frame to stabilize the electrical impulse actuated means.

4. A counter according to claim 1, wherein the armature engages the pawl means through a tongue and slot coupling, the tongue and slot being formed respectively on different ones of the armature and the pawl means.

5. A counter according to claim 1, wherein the reciprocally movable pawl means comprises a pawl freely rotatably mounted on said second shaft.

6. A counter according to claim 5, wherein the pawl is formed with a slot extending generally radially of the second shaft and cooperable with a tongue formed integrally with the armature.

7. A counter according to claim 1, wherein the parts of the housing are each formed with channels adapted to engage and retain edges of a base or mounting plate of the counter to enable the base or mounting plate to be trapped between the two housing parts as these parts are brought together on assembly of the counter.

8. A counter according to claim 7, wherein the parts of the housing are each formed with facing channels which are collinear with and form continuous channels with similar channels on the other part of the housing, the continuous channels respectively engaging and retaining opposite parallel edges of the base or mounting plate.

9. An electrical impulse operated number wheel counter, comprising a housing formed of first and second housing parts of plastics material, said parts being mutually engagable as a friction fit; first and second parallel shafts located at their ends within recesses of the first housing part said recesses being closed by opposed abutments of the second housing part; a series of co-axial freely rotatable number wheels mounted on the first shaft; transfer pinions freely rotatably mounted on the second shaft and respectively disposed intermediate successive number wheels, each pinion meshing with gear teeth on one of the number wheels adjacent thereto and adapted to engage drive means on the other number wheel during rotation of said other number wheel thereby partially to rotate said one of the number wheels; a pawl freely rotatably mounted on said second shaft and engagable with teeth on a number wheel at an end of the series of number wheels thereby to rotate said number wheel to effect counting of the counter, the pawl being formed with a slot extending radially of the second shaft; and an electrical impulse actuated sub-assembly located within the housing solely through engagement with integral elements of at least said first housing part and comprising a metallic frame, a solenoid mounted on the frame, a metallic armature supported for pivotal movement on the frame about an axis parallel with said first and second shafts and biassing means serving, when the solenoid is de-energised, to keep the armature out of engagement with the solenoid, the armature having a tongue engaged within said slot of the pawl to effect reciprocal movement of the pawl when an electrical impulse energises the solenoid.

* * * * *